US005091835A

United States Patent [19]

Malek et al.

[11] Patent Number: 5,091,835

[45] Date of Patent: Feb. 25, 1992

[54] HIGH INTENSITY LAMP WITH IMPROVED AIR FLOW VENTILATION

[75] Inventors: Jack H. Malek, Northridge; John L. Leonetti; Gilbert Rosales, both of Los Angeles, all of Calif.

[73] Assignee: Leonetti Company, Hollywood, Calif.

[21] Appl. No.: 660,398

[22] Filed: Feb. 25, 1991

[51] Int. Cl.[5] ..... F24V 29/00

[52] U.S. Cl. ..... 362/294; 362/345; 362/373

[58] Field of Search ..... 362/294, 345, 373, 350

[56] References Cited

U.S. PATENT DOCUMENTS

| | | | |
|---|---|---|---|
| D. 297,171 | 8/1988 | Parker . | |
| 1,323,819 | 12/1919 | Bohan | 362/350 |
| 2,080,120 | 5/1937 | Everett | 362/294 |
| 3,267,274 | 11/1963 | Johnson . | |
| 3,538,324 | 11/1970 | Hankins . | |
| 3,633,024 | 1/1972 | Hankins . | |
| 4,630,182 | 12/1986 | Moroi et al. | 362/294 |
| 4,885,508 | 12/1989 | Krokaugger . | |
| 4,974,132 | 11/1990 | Naum . | |

*Primary Examiner*—Carroll B. Dority
*Attorney, Agent, or Firm*—Kelly, Bauersfeld & Lowry

[57] ABSTRACT

A high intensity lamp is provided for use in studio and theatrical lighting applications and the like, wherein the lamp includes an improved ventilated lamp housing for enhanced convective air flow to dissipate generated heat energy. The lamp housing has a generally cylindrical shape with a high intensity lamp bulb supported therein and a forward open end. The lamp housing is constructed from a plurality of inner and outer rings assembled in a concentric and axially overlapping relation to define a sequence of radially and axially open flow paths of expanding cross-sectional size to induce an enhanced convective cooling air flow from the interior to the exterior of the lamp housing. In addition, a curved reflector and a forward lens associated with the high intensity lamp bulb are removably supported on peripheral spring clips within the lamp housing, wherein these spring clips retain the reflector and the lens in spaced relation with the lamp housing to define additional axial flow paths for additional housing air flow ventilation.

21 Claims, 4 Drawing Sheets

FIG. 1
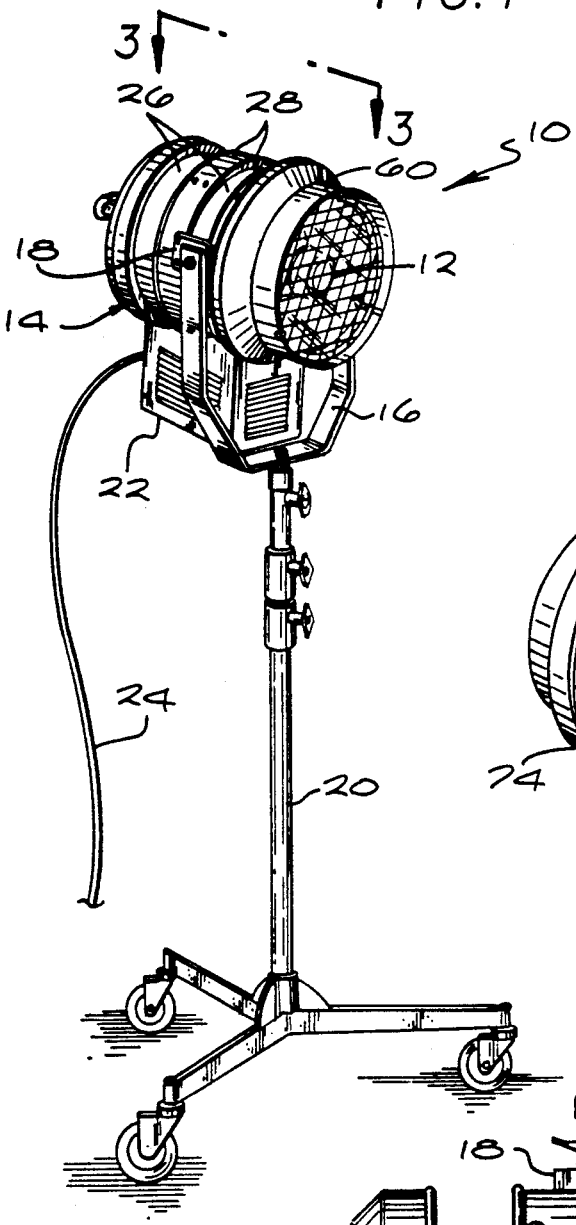
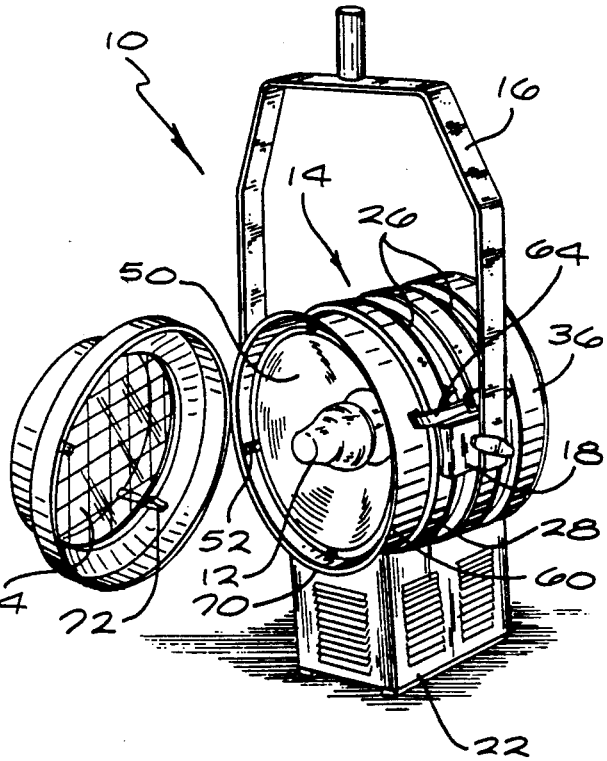
FIG. 2
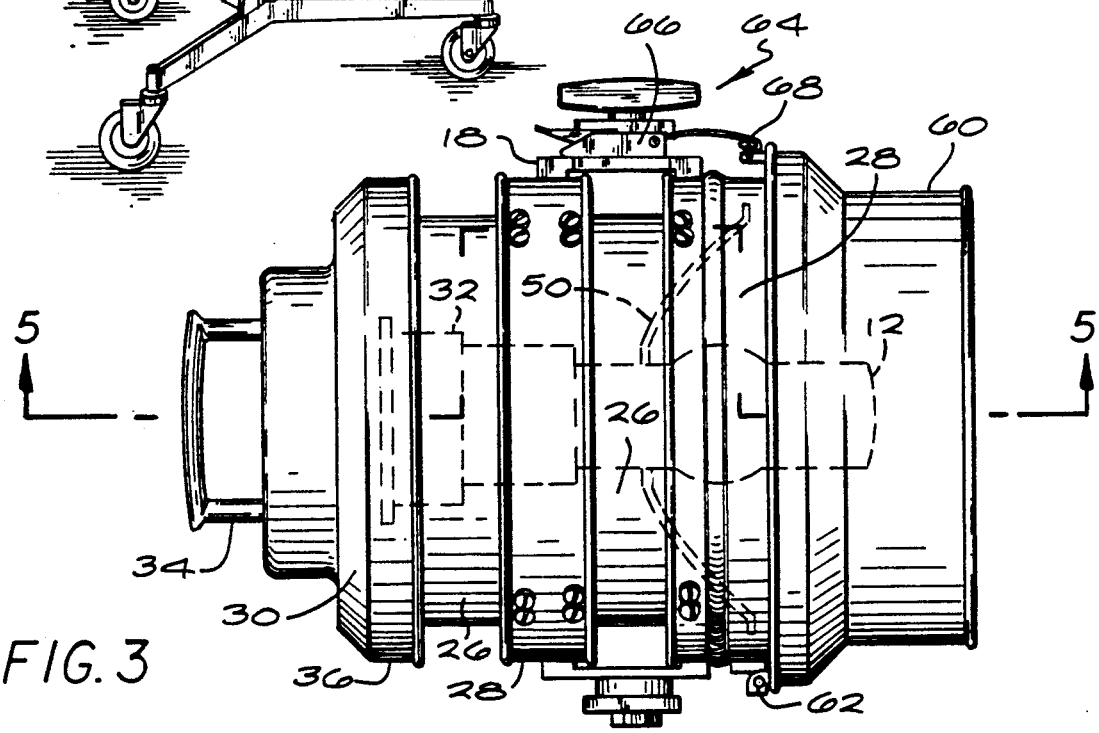
FIG. 3

FIG. 5
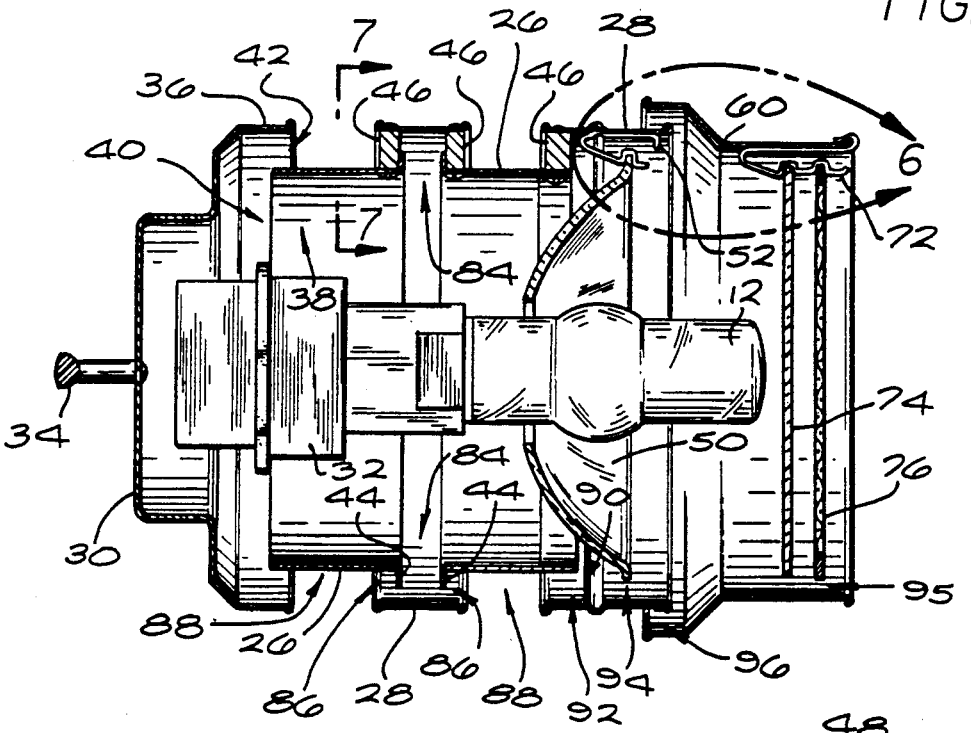
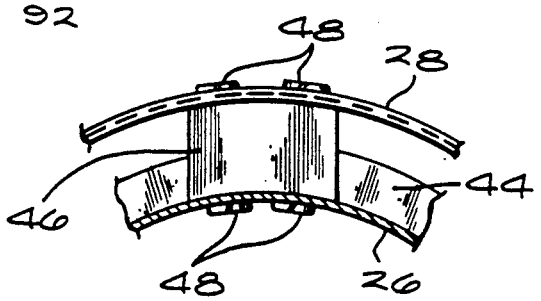
FIG. 7
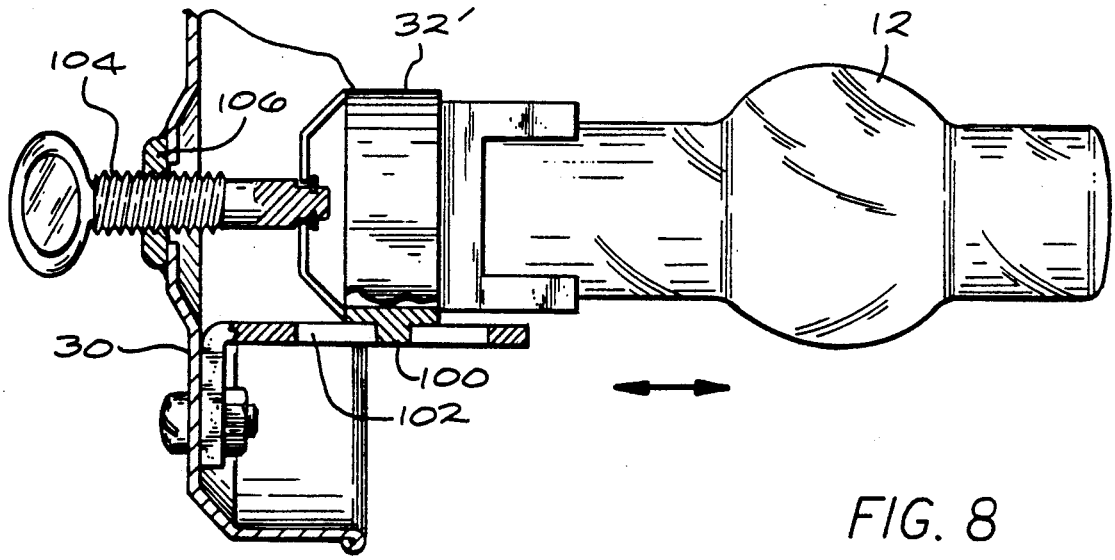
FIG. 8

HIGH INTENSITY LAMP WITH IMPROVED AIR FLOW VENTILATION

BACKGROUND OF THE INVENTION

This invention relates generally to improvements in high intensity lighting equipment particularly of the type used in the theater, motion picture and television industries for illuminating stage and studio sets, location scenes, and the like. More specifically, this invention relates to an improved high intensity lamp adapted for enhanced cooling air flow to dissipate generated heat energy.

High intensity lamps are known in the art for use as spotlights and for general lighting purposes in theatrical, motion picture and television productions and the like. Examples of such high intensity lamps include gas vapor, arc, metal halide (HMI) or equivalent type, all of which commonly include a metal lamp housing having an appropriate high intensity bulb or globe mounted therein, with HMI globes being relatively standard in the industry. Such high intensity HMI globes are known to generate substantial quantities of heat energy during normal operation, with lamp globe surfaces typically exhibiting a temperature on the order of about 600–800° C. (about 1100–1500° F.). This heat energy must be effectively and continuously dissipated to prevent premature bulb failure, and further to permit handling of the lamp housing by personnel in the course of lighting regulation and adjustments.

In the past, lamp housings for high intensity lamps of this general type have been constructed from metal materials suited for absorbing the generated heat energy and for dissipating the energy to the surrounding air. In this regard, the lamp housing is usually ventilated so that heat dissipation will be enhanced by the effects of convective air currents to the exterior of the lamp housing. While the use of a cooling fan for enhanced convection air flow is known in the art, cooling fans are not normally used in theatrical and studio environments due to objectionable fan noise. Accordingly, to obtain adequate heat absorption and dissipation capability, the size and surface area of the metal lamp housing has generally been increased to result in a large equipment item which can be difficult to handle and manipulate. Smaller lamp housings adapted for easier transport and handling have generally not provided adequate heat dissipation capability and have been limited to use of lower power lamp bulbs.

The present invention provides an improved high intensity lamp wherein the lamp housing has a relatively compact size and shape but is adapted for improved convective ventilation air flow for dissipating generated heat energy.

SUMMARY OF THE INVENTION

In accordance with the invention, an improved high intensity lamp is provided of the type used in theatrical and studio lighting applications and the like, wherein the lamp comprises a compact lamp housing having a high intensity bulb such as an HMI bulb or globe contained therein. The lamp housing is constructed to include a plurality of rings assembled in spaced relation to provide for increased heat transfer capacity. The housing rings absorb heat from the bulb by radiation and convection, and transfer this hear through inter-ring openings and to exterior surfaces of the rings for improved heat transfer away from the lamp housing. With this construction, the lamp housing is designed for improved convective cooling air flow during lamp operation to dissipate generated heat energy.

In accordance with the preferred form of the invention, the lamp housing comprises a plurality of inner and outer concentric rings of metallic material and assembled in axially overlapping relation to define a generally cylindrical structure for encasing the high intensity bulb or globe therein. The assembled array of inner and outer rings defines a sequence of radially and axially open flow paths of expanding or diverging geometry leading from the interior to the exterior of the lamp housing. With this configuration, during lamp operation, a substantial convective cooling air flow is induced in an upward direction through the lamp housing for carrying away generated heat energy. The specific sequence of flow paths includes a radially outwardly open first passage between the axially spaced inner rings, followed by an axially open second passage of larger cross sectional area defined by the collective axial spacing between the inner and outer sets of rings, followed in turn by a radially outwardly open third passage of still larger cross sectional area defined by the collective space between the outer rings.

In accordance with further aspects of the invention, the improved lamp housing includes a plurality of spring clips for supporting a curved reflector and a forward lens in association with the high intensity lamp bulb. These spring clips removably support the reflector and lens within the lamp housing, and in radially inward spaced relation from the lamp housing. As a result, additional annular flow paths around the peripheries of the reflector and lens are formed for additional convective air flow from the interior of the lamp housing during operation.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view illustrating an improved high intensity lamp embodying the novel features of the invention and shown supported on a conventional tripod stand;

FIG. 2 is an enlarged front perspective view of the lamp removed from the tripod stand and showing a hinged forward lens support ring in an open position;

FIG. 3 is an enlarged top plan view of the lamp taken generally on the line 3—3 of FIG. 1;

FIG. 5 is an enlarged fragmented vertical sectional view taken generally on the line 5—5 of FIG. 3;

FIG. 7 is an enlarged fragmented vertical sectional view taken generally on the line 7—7 of FIG. 5;

FIG. 8 is an enlarged and somewhat diagrammatic sectional view similar to a portion of FIG. 5 but illustrating one alternative preferred form of the invention.

DETAILED DESCRIPTION OF THE PREFERRED EMBODIMENTS

Figure 4:
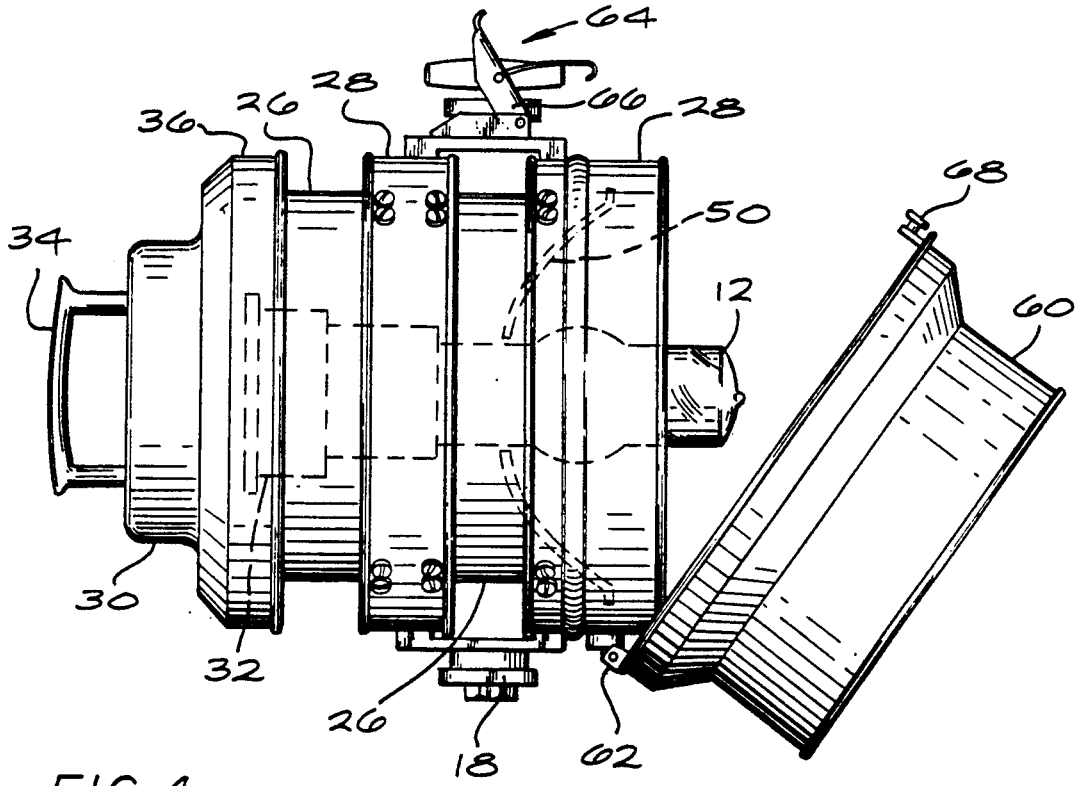
FIG. 4 is a top plan view similar to FIG. 3 but showing the forward lens support ring in an open position.
Figure 6:
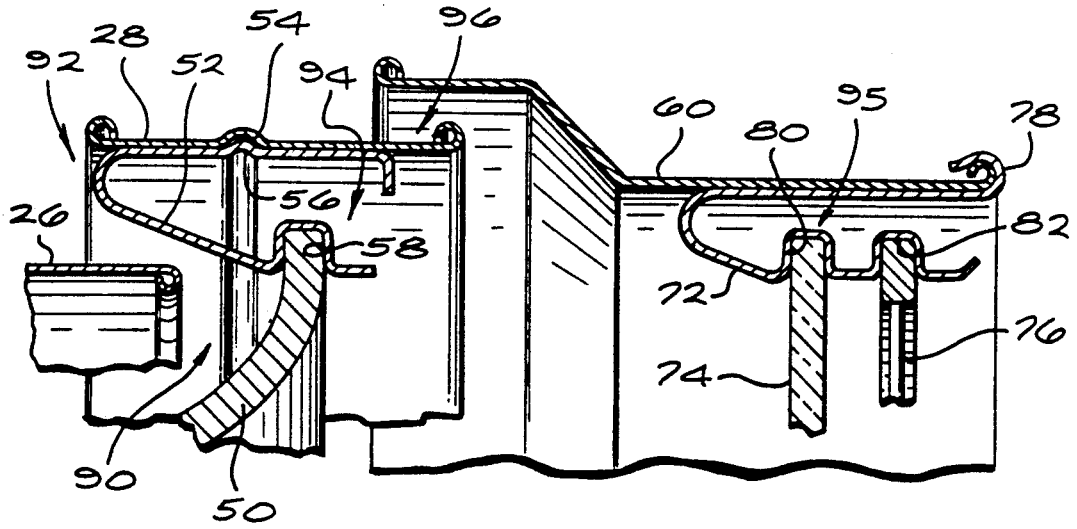
FIG. 6 is a further enlarged fragmented sectional view of a portion of the lamp corresponding with the encircled region 6 of FIG. 5.

As shown in the exemplary drawings, an improved high intensity lamp referred to generally in FIG. 1 by the reference numeral 10 is provided for use in theatrical and/or studio lighting applications in the theater, motion picture, and television industries and the like. The lamp 10 includes a high intensity lamp bulb or globe 12 of the type known to generate substantial heat energy during normal operation. In accordance with the invention, the lamp globe 12 is safely encased within an improved lamp housing 14 designed for improved convective air flow ventilation to correspondingly provide enhanced heat dissipation with a compact lamp housing geometry.

The improved high intensity lamp 10 of the present invention is normally used to provide a spotlight or for general lighting purposes in a theatrical stage, studio or on-location in the entertainment industry or the like. In this regard, the lamp globe or bulb 12 typically comprises a gas vapor arc lamp such as a so-called HMI globe commonly used in such lighting applications. High intensity lamps of this general type are known to produce relatively large quantities of heat energy which must be continuously and effectively dissipated to insure safe lamp operation without premature lamp failure. For example, HMI globes having metal arc elements encased within a glass bulb are known to operate at glass surface temperatures of about 600–800° C. (about 1100–1500° F.). This substantial heat energy is effectively dissipated by the improved lamp housing 14 which is designed to induce an improved and substantial convection air flow from the interior to the exterior of the lamp housing, and without the use of a cooling fan and the objectionable noise associated therewith.

As shown generally in FIGS. 1 and 2, the lamp housing 14 has a generally cylindrical overall shape to receive and support the high intensity lamp bulb or globe 12 which is adapted to produce a high intensity beam of light for discharge from a forward open end of the housing 14. A conventional bale 16 is connected to opposite sides of the housing 14 by means of releasable clamp blocks 18 or the like to permit mounting of the lamp onto a conventional tripod stand 20 (FIG. 1) or alternative suspension from an overhead track (not shown) with the bale 16 oriented as viewed in FIG. 2.

The lamp 10 includes a power unit 22 in the form of a compact and generally rectangular box mounted at the underside of the lamp housing 14. The power unit 22 includes, in a manner known to persons skilled in the art, appropriate electronic components for connecting the lamp globe 12 to a suitable electrical power source via a power cord 24. These electronic components (not shown) function to provide an amplified ignition voltage to ignite or start the lamp, followed by steady state supply of an appropriate lower voltage signal for sustained lamp operation.

The lamp housing 14 comprises an assembled array of inner and outer concentric rings 26 and 28 which collectively define a ventilated cylindrical enclosure for the lamp globe 12. More particularly, as viewed best in FIGS. 3–7, the lamp housing 14 includes a rear support plate 30 which closes the rear end of the housing 14 and provides a support base for mounting a socket unit 32 adapted for removably receiving the lamp globe 12. A handle 34 is conveniently mounted at the outboard or exterior side of the rear support plate 30 to permit manual handling of the lamp 10 during operation. In this regard, it will be understood that the handle 34 will normally be constructed from or otherwise surface coated with a material having low heat transmissivity to permit safe manual grasping and manipulation during lamp operation.

The rear support plate 30 is securely mounted onto the underlying power unit 22 by means of screws or the like (not shown). A forward margin of this rear support plate 30 defines a short, axially forwardly extending shroud 36 disposed in radially outwardly spaced relation to the socket unit 32. One of the inner rings 26 is mounted in generally coaxial relation with the rear shroud 36, wherein the diametric size of this inner ring 26 is selected to be significantly less that the diametric size of the shroud 36. A rear margin of the inner ring 26 is axially overlapped a short distance with respect to a forward margin of the shroud 36. In other words, the rear margin of the inner ring 26 disposed immediately adjacent to the shroud 36 is positioned at an axial location slightly aft of a forward margin of the shroud 36. However, the diametric sizes and the relative axial positions of these components provides a substantial radial spacing between the inner ring 26 and the socket unit 32, as referenced by arrow 38 (FIG. 5), as well as a substantial axial spacing between the rear margin of the ring 26 and the adjacent support plate 30, as referenced by arrow 40. In addition, a substantial radial space referenced by arrow 42 is formed concentrically between the ring 26 and the shroud 36.

The rear inner ring 26, as described above, is connected in axially overlapped and concentric relation with one of the outer rings 28 which is mounted in turn onto the top of the power unit 22 by screws or the like (not shown). This outer ring 28 is positioned concentrically about the above described inner ring 26 and conveniently has a diametric size corresponding generally with the rear shroud 36. A rear margin of the outer ring 28 is axially overlapped with a forward margin of the inner ring 26, with the forward inner ring margin conveniently including a radially out-turned flange 44 terminating in spaced relation to the outer ring 28. A plurality of relatively small spacer blocks 46 (FIG. 7) may be connected between the overlapping margins of the concentric rings 26 and 28 by means of screws 48 or the like, with three or four of the spacer blocks 46 being provided in preferred forms of the invention.

A second inner ring 26 is connected in turn to the above described outer ring 28 in a similar concentric and axially overlapping manner to project forwardly therefrom. A rear margin of this second inner ring 26 desirably includes an out-turned flange 44 and is connected with the outer ring 28 by means of an additional set of the spacer blocks 46. A forward margin of the second inner ring 26 is then connected by still another set of the spacer blocks 46 to a second outer ring 28 which extends forwardly therefrom in concentric and axially overlapping relation. Accordingly, the inner and outer rings 26 and 28 are assembled in an alternating coaxial sequence with slight axial overlap sufficient to prevent escape of light in a radial direction through the vented housing.

The second or forward outer ring 28 is adapted for removably supporting a curved reflector 50 of parabolic shape or the like about the lamp globe 12 seated within the socket unit 32. This reflector mounting is achieved by use of a plurality of generally V-shaped spring clips 52 which support the reflector in radially inward spaced relation within the ring 28. More particularly, the second or forward outer ring 28 includes an internal groove 54 adapted for seated reception of a detent 56 (FIG. 6) formed in an outer leg of each spring clip 52. The engagement between the ring groove 54 and the detent 56 locates the spring clip at a selected axial location within the lamp housing 14, and correspondingly orients a shaped recess 58 in an opposite leg of each spring clip for receiving and supporting the peripheral edge of the reflector 50. In the preferred form, three or four of the spring clips 52 are provided for supporting the reflector generally centered but radially spaced within the housing ring 28.

A forward lens support ring 60 is mounted onto the forward end of the lens housing 14 by means of a hinge assembly 62 or the like at one side of the forward housing ring 28 (FIGS. 3 and 4). A releasable latch assembly 64, such as a suitcase type latch 66 and associated keeper 68 are mounted on an opposite side of the ring components 28 and 60 to permit swinging movement of the support ring 60 between a closed and locked position (FIGS. 1, 3 and 5) and an open position (FIGS. 2 and 4) permitting replacement access to the lamp globe 12. A safety switch 70 (FIG. 2) on the front of the power unit 22 may be provided for engagement by the forward lens support ring 60 in the closed and locked position, such that lamp operation may be prevented or disrupted for safety purposes when the support ring 60 is pivoted to the open position.

Additional spring clips 72 are mounted within the forward support ring 60 for removably supporting a front lens 74 and, if desired, a protective front grille 76. The spring clips 72 are shown to have a V-shaped construction with each spring clip including an outer leg having a rolled end 78 fitted over the front edge of the support ring 60. An inner leg for each spring clip 72 includes at least one recess 80 for seated support of the peripheral edge of the front lens 74. In the preferred form, each spring clip 72 further includes a second recess 82 for receiving the peripheral edge of the protective grille 76. Once again, either three or four of the spring clips 72 are provided to removably support the lens and grille in radially inward spaced relation to the support ring 60. Alternately, these forward spring clips 72 may be mounted within the forward support ring 60 by other mechanical mounting techniques, including but not limited to direct screw-on attachment of the outer leg of each spring clip 72 to the support ring 60 by means of screws or the like (not shown).

The thus-assembled lamp housing 14 defines multiple flow paths for ventilation air flow from the interior of the lamp housing 14 to the exterior. That is, the rear outer ring 28 maintains the two inner rings 26 in axially spaced relation to permit air flow radially outwardly therebetween through an annular passage identified by arrow 84 (FIG. 5). This flow passage 84 communicates in turn with an axially extending pair of flow passages 86 disposed concentrically about the inner rings 26, followed sequentially by communication with a pair of radially outwardly open flow passages 88 at opposite sides of the rear outer ring 28. Similarly, at the front of the forward inner ring 26, a radially outwardly open flow path referred to by arrow 90 is formed between the ring 28 and the reflector 50, wherein this flow passage 90 communicates rearwardly with a flow passage 92 formed about the forward ring 26, and forwardly with an annular flow passage 94 formed about the reflector 50. This latter flow passage 94 leads to a forwardly open annular passage 95 formed about the lens 74, and a rearwardly open annular passage 96 formed between the forward margin of the front outer ring 28 and an externally overlapping and diametrically expanded rear end of the lens support ring 60.

The arrangement of the flow passages leading from the interior to the exterior of the lamp housing 14 is specifically designed to provide an expanding cross sectional flow area which effectively induces a strong convection ventilation air flow during lamp operation. More particularly, the combined flow areas provided by the radially outwardly open flow passages 40, 84 and 90 is substantial to provide significant air flow capacity from the interior of the lamp housing, but this combined flow area is significantly less than the combined flow area provided by the axially open flow passages 42, 86, 92 and 94. These axial passages 42, 86, 92 and 94 in turn provide a flow area significantly less that the combined area provided by the radially outwardly open flow passages 88 in combination with the passages 95 and 96 leading from the forward lens support ring 60. With this construction, the expanding throat geometry provided by the sequence of flow passages provides strong and effective convective air flow for enhanced heat dissipation. That is, the air flow yields improved absorption of radiated, convected and conducted heat, with the direction changing flow paths providing enhanced air heating as it flows through the lamp housing. Such heat dissipation is further assisted by constructing the various housing ring elements from a metal material, such as aluminum or the like chosen for relatively high heat transfer characteristics, with interior surfaces thereof being preferably painted or otherwise surface treated to be black in color for improved radiative and convective absorption of heat generated by the lamp.

FIG. 8 shows one alternative form of the invention wherein the lamp globe 12 is supported within a modified socket unit 32' adapted for fore-aft focus adjustment within a lamp housing. In this embodiment, the socket unit 32' includes a key 100 adapted for fore-aft displacement along a slotted track 102 or the like mounted on the rear support plate 30 of the lamp housing. An adjustment screw 104 extends through a threaded nut 106 on the rear support plate and includes a nose end secured to the socket unit 32', such that adjustment screw rotation effectively translates the socket unit 32' and the lamp globe 12 supported thereby through a fore-aft range of adjustment. If desired, in this embodiment, the reflector (not shown in FIG. 8) may be mounted onto the socket unit 32, for fore-aft adjustment movement therewith.

Figure 9:
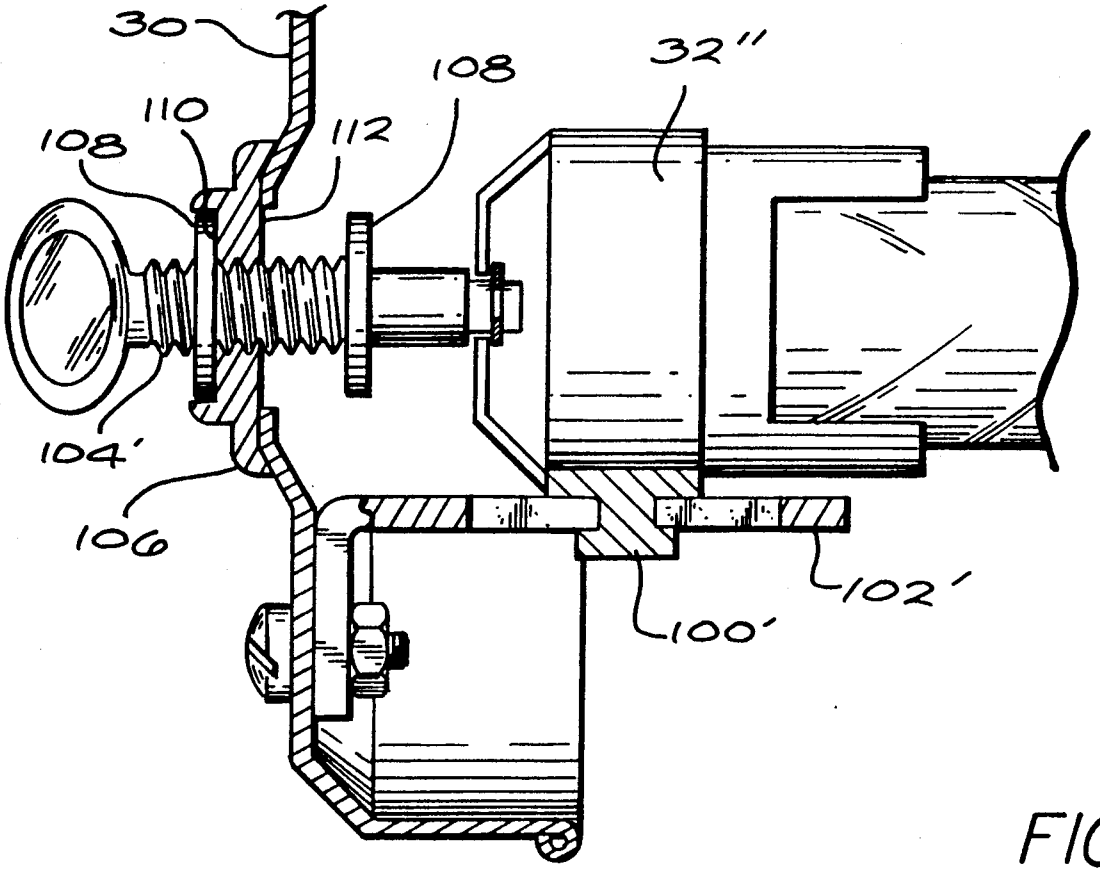
FIG. 9 is an enlarged and somewhat diagrammatic sectional view similar to FIG. 8 and showing a further alternative preferred form of the invention.

FIG. 9 illustrates another alternative form of the invention wherein a modified socket unit 32'' for supporting a lamp globe (not shown) is adapted for fore-aft focus adjustment within a lamp housing. In the embodiment of FIG. 9, the socket unit 32'' and associated adjustment mechanism are designed for displacement of the socket unit between forward and rearward set or stop positions which may be correlated respectively with a pair of lamp globes of different size and/or type. With this construction, the adjustment mechanism provides fixed focal point positions for different lamp globe types, while additionally providing for the fine tuned focal point adjustment.

More specifically, with reference to FIG. 9, the modified socket unit 32'' includes a key 100' for guided fore-aft displacement along a slotted track 102' upon rotation of an adjustment screw 104'. The adjustment screw 104' has a nose end secured to the socket unit 32' and further includes a threaded shank extending rearwardly through a threaded nut 106' mounted on the rear support plate of the lamp housing. A pair of stop rings 108 are fixedly mounted onto the screw at axially spaced positions for engaging a corresponding pair of stops 110 and 112 defined at opposite axial ends of the nut 106'. That is, as shown in FIG. 9, the adjustment screw 104' can be threadably advanced within the nut 106' to engage the rear stop ring 108 with the stop 110 at the rear side of the nut to define one reference position. Alternately, the screw 104' can be threadably retracted within the nut to engage the forward stop ring 108 with the forward stop 112 on the nut, thereby defining a second reference position.

The improved high intensity lamp 10 of the present invention thus provides a lamp housing with significantly improved convective air flow ventilation to maintain the lamp globe 12 at a desired and reduced operating temperature. With the enhanced convective air flow, the overall size of the lamp housing 14 may be reduced relative to prior lamps of similar power. Alternately, relatively higher power lamp globes may be used for improved lighting performance without requiring the use of a larger lamp housing.

A variety of further modifications and improvements to the invention will be apparent to those skilled in the art. Accordingly, no limitation on the invention is intended by way of the foregoing description and accompanying drawings, except as set forth in the appended claims.

What is claimed is:

1. A high intensity lamp, comprising:

a generally cylindrical lamp housing having an open forward end; and a socket unit within said lamp housing for removably supporting a high intensity lamp globe;

said lamp housing including a plurality of inner and outer rings, and means for connecting said inner and outer rings in an alternating, generally coaxial and axially overlapping relation to define a first radially outwardly open flow path formed by the combined open axial area between said inner rings, a second axially open flow path formed by the combined open radial area between said inner and outer rings, and a third radially outwardly open flow path formed by the combined open axial area between said outer rings;

said second flow path having an open flow area significantly greater than said first flow path, and said third flow path having an open flow area significantly greater than said second flow path.

2. The high intensity lamp of claim 1 further including a curved reflector, and means for mounting said curved reflector within said lamp housing to define an annular flow path disposed between said reflector and said housing.

3. The high intensity lamp of claim 2 wherein said reflector mounting means comprises a plurality of spring clips reacting between said housing and a peripheral edge of said curved reflector.

4. The high intensity lamp of claim 3 wherein one of said inner and outer rings has a groove formed therein, and further wherein each of said spring clips includes detent means for seated engagement with said groove, each of said spring clips further including a recessed seat for reception of the peripheral edge of said curved reflector.

5. The high intensity lamp of claim 1 further including a forward lens, and means for mounting said forward lens within said lamp housing to define an annular flow path disposed between said forward lens and said housing.

6. The high intensity lamp of claim 5 wherein said forward lens mounting means comprises a plurality of spring clips reacting between said housing and a peripheral edge of said forward lens.

7. The high intensity lamp of claim 6 further including a safety grille, each of said spring clips further reacting between said housing and a peripheral edge of said safety grille to support said safety grille within said housing.

8. The high intensity lamp of claim 5 wherein said housing further includes a forward lens support ring, hinge means for pivotally supporting said forward lens support ring for swinging movement between open and closed positions, and latch means for releasibly locking said forward lens support ring in said closed position, said forward lens being mounted within said forward lens support ring.

9. The high intensity lamp of claim 8 further including safety switch means for preventing operation of said lamp when said forward lens support ring is in the open position.

10. The high intensity lamp of claim 1 wherein said lamp housing is formed from metal material.

11. The high intensity lamp of claim 1 wherein said lamp housing defines black interior surfaces.

12. The high intensity lamp of claim 1 further including means for adjusting the position of said socket unit in a fore-aft direction within said lamp housing.

13. The high intensity lamp of claim 12 wherein said adjusting means includes means defining first and second reference positions of socket unit adjustment.

14. A high intensity lamp, comprising:

a generally cylindrical lamp housing having an open forward end; and a socket unit within said lamp housing for removably supporting a high intensity lamp globe;

said lamp housing having a portion thereof defined by a plurality of inner and outer rings, and further including means for connecting said inner and outer rings in an alternating, generally coaxial and axially overlapping relation, said inner and outer rings defining a vented flow path having an expanding cross sectional area and leading from the interior to the exterior thereof to induce a substantial and unforced convection air flow from the interior to the exterior of said lamp housing to dissipate heat generated during lamp operation.

15. The high intensity lamp of claim 14 further including a high intensity lamp globe supported by said lamp socket unit.

16. The high intensity lamp of claim 14 further including a curved reflector, and means for mounting said curved reflector within said lamp housing in radially inward spaced relation with respect to said lamp housing to define an annular flow path disposed between said reflector and said housing.

17. The high intensity lamp of claim 14 wherein said inner and outer rings define a first radially outwardly open flow path formed by the combined open axial area between said inner rings, a second axially open flow path formed by the combined open radial area between said inner and outer rings, and a third radially outwardly open flow path formed by the combined open axial area between said outer rings, said second flow path having an open flow area significantly greater than said first flow path, and said third flow path having an open flow area significantly greater than said second flow path.

18. The high intensity lamp of claim 14 further including a forward lens, and means for mounting said forward lens within said lamp housing to define an annular flow path disposed between said forward lens and said housing.

19. The high intensity lamp of claim 18 wherein said housing further includes a forward lens support ring, hinge means for pivotally supporting said forward lens support ring for swinging movement between open and closed positions, and latch means for releasably locking said forward lens support ring in said closed position, said forward lens being mounted within said forward lens support ring.

20. The high intensity lamp of claim 14 wherein said lamp housing is formed from metal material.

21. The high intensity lamp of claim 14 wherein said lamp housing defines black interior surfaces.

* * * * *